US009222477B2

(12) United States Patent
Durham et al.

(10) Patent No.: US 9,222,477 B2
(45) Date of Patent: Dec. 29, 2015

(54) METHOD AND SYSTEM OF SUBMERSIBLE PUMP AND MOTOR PERFORMANCE TESTING

(71) Applicant: GICON PUMP & EQUIPMENT, LTD., Abernathy, TX (US)

(72) Inventors: R. Mark Durham, Lubbock, TX (US); M. Bryan Sherrod, Wilson, TX (US); Ronald K. Hensley, Lubbock, TX (US); Gary D. Grant, Abernathy, TX (US)

(73) Assignee: Gicon Pump & Equipment, Ltd., Abernathy, TX (US)

( * ) Notice: Subject to any disclaimer, the term of this patent is extended or adjusted under 35 U.S.C. 154(b) by 0 days.

(21) Appl. No.: 14/310,534

(22) Filed: Jun. 20, 2014

(65) Prior Publication Data

US 2014/0301869 A1 Oct. 9, 2014

Related U.S. Application Data

(63) Continuation-in-part of application No. 13/083,728, filed on Apr. 11, 2011, now Pat. No. 8,776,617.

(51) Int. Cl.

| | |
|---|---|
| ***G01L 3/00*** | (2006.01) |
| ***F04D 15/00*** | (2006.01) |
| ***F04B 51/00*** | (2006.01) |
| ***F04B 23/02*** | (2006.01) |

(52) U.S. Cl.

CPC ..... *F04D 15/0088* (2013.01); *F04B 23/021* (2013.01); *F04B 51/00* (2013.01)

(58) Field of Classification Search

None

See application file for complete search history.

(56) References Cited

U.S. PATENT DOCUMENTS

| | | | | |
|---|---|---|---|---|
| 4,416,586 | A | 11/1983 | Diederich | |
| 5,159,977 | A | 11/1992 | Zabaras | |
| 5,499,530 | A | 3/1996 | Vondell | |
| 5,589,633 | A | 12/1996 | McCoy | |
| 6,045,333 | A | 4/2000 | Breit | |
| 6,260,004 | B1 | 7/2001 | Hays | |
| 6,450,023 | B1 * | 9/2002 | Addie et al. | 73/168 |

(Continued)

FOREIGN PATENT DOCUMENTS

| | | |
|---|---|---|
| CN | 2704824 Y | 6/2005 |
| CN | 201606352 | 10/2010 |

OTHER PUBLICATIONS

W.P. O'Toole, Testing New Submersible Pumps for Proper Sizing and Reduced Costs, Journal of Petroleum Technology, Feb. 1989.

(Continued)

*Primary Examiner* — Lisa Caputo
*Assistant Examiner* — Brandi N Hopkins
(74) *Attorney, Agent, or Firm* — Mark E. Scott; Conley Rose, P.C.

(57) ABSTRACT

Submersible pump and motor performance testing. At least some of the illustrative embodiments are methods including: coupling a torque meter between an electric motor and a pump; and submersing the torque meter, electric motor, and pump in water. During periods of time when the torque meter, electric motor and pump are submerged in the water, the method comprises: operating the pump and the electric motor; measuring pump performance; and simultaneously measuring electric motor performance.

24 Claims, 7 Drawing Sheets

(56) References Cited

U.S. PATENT DOCUMENTS

| | | | | |
|---|---|---|---|---|
| 6,468,058 | B1 | 10/2002 | Breit | |
| 6,729,848 | B1 | 5/2004 | Hasslen | |
| 6,776,584 | B2 | 8/2004 | Sabini | |
| 6,911,752 | B1 | 6/2005 | Breit | |
| 7,047,802 | B2 | 5/2006 | Seys | |
| 7,668,694 | B2 * | 2/2010 | Anderson et al. | 702/182 |
| 7,701,106 | B2 | 4/2010 | Yuratich | |
| 7,748,449 | B2 | 7/2010 | Bussear | |
| 7,775,102 | B2 | 8/2010 | Haerer | |

OTHER PUBLICATIONS

Joseph R. Pottebaum; Optical Characteristics of a Variable-Fequency centrifugal Pump Motor Drive, Industry Applications, IEEE Transactions on Jan. 1984, vol. 1A-20 Issue 1, p. 23-31.

Models 703 & 733 Voltage Conditioners Accurate, Versatile, User Friendly—Bulletin 374C, 2001, 2002 S. Himmelstein and Company.

MCRT 79700V Non-Contact—Dual Range Digital Torquemeters, Best Performance Under Real-World Conditions—2009, 2010 S. Himelstein and Company.

* cited by examiner

METHOD AND SYSTEM OF SUBMERSIBLE PUMP AND MOTOR PERFORMANCE TESTING

CROSS REFERENCE TO RELATED APPLICATIONS

This is a continuation-in-part of U.S. patent application Ser. No. 13/083,728 filed Apr. 11, 2011, which is incorporated herein by reference as if fully reproduced below.

BACKGROUND

Purchasers of industrial scale water pumping systems (e.g., cities, municipalities, water districts) compare proposed pumping systems based not only on price, but also performance. That is, even for two proposed pumping systems from two different suppliers having the same purchase price, the long term cost of the systems may be significantly different, based on parameters such as electric motor efficiency and pump efficiency.

In some cases, overall efficiency of a pump and electric motor combination may be theoretically determined by mathematically combining standard pump information for the pump (e.g., pump "curves" that relate parameters such as head pressure, flow rate, and revolutions per minute (RPM) of the pump) with standard electric motor information (e.g., information that relates motor speed, torque, electrical efficiency). However, the standard information in most cases applies to a model of pump, not a specific pump. Likewise, the standard electric motor information applies to a model of an electric motor, not a specific electric motor. Because of variations in the manufacturing process, actual pump performance and actual motor performance varies from the standard information. Thus, better information regarding performance is gathered when performance of the specific pump is measured, and likewise better information is gathered when performance of the specific electric motor is measured. Simultaneous measurement of performance of the specific pump coupled to the specific motor may provide the best overall information.

However, for vertical shaft submersible pump packages, where both the pump and the electric motor are designed for operation submersed in water and with their respective rotors held in a vertical orientation, combined performance testing in the designed operational configuration has not, to date, been achievable.

BRIEF DESCRIPTION OF THE DRAWINGS

For a detailed description of exemplary embodiments, reference is made to the accompanying drawings, not necessarily to scale, in which.

NOTATION AND NOMENCLATURE

Certain terms are used throughout the following description and claims to refer to particular system components. As one skilled in the art will appreciate, different companies may refer to a component by different names. This document does not intend to distinguish between components that differ in name but not function.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection or through an indirect electrical connection via other devices and connections.

"Substantially" shall mean, with respect to orientation of a rotatable shaft, the rotatable shaft is within plus or minus 45 (forty-five) degrees (angle) of a vertical orientation.

"Non-conductive oil" shall mean oil having conductivity of 2000 picosiemens per meter (pS/m) or less when measured at 25 degrees Celsius.

DETAILED DESCRIPTION

The following discussion is directed to various embodiments of the invention. Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to intimate that the scope of the disclosure, including the claims, is limited to that embodiment.

At least some of the embodiments discussed herein are directed to measuring performance of pump packages comprising submersible pumps and submersible electric motors. At least some embodiments are directed to simultaneously measuring submersible pump performance and submersible electric motor performance while the pump and electric motor are submerged. At least some embodiments are directed to simultaneously measuring submersible pump performance and submersible electric motor performance while the pump and electric motor are submerged and while the rotatable shafts of the both the pump and electric motor are held in a vertical orientation. At least some embodiments discussed herein are directed to measuring loss of fluid from the vessel that contains the torque meter. At least some embodiments discussed herein are directed to detecting invasion of water into the vessel that contains the torque meter.

Figure 1:
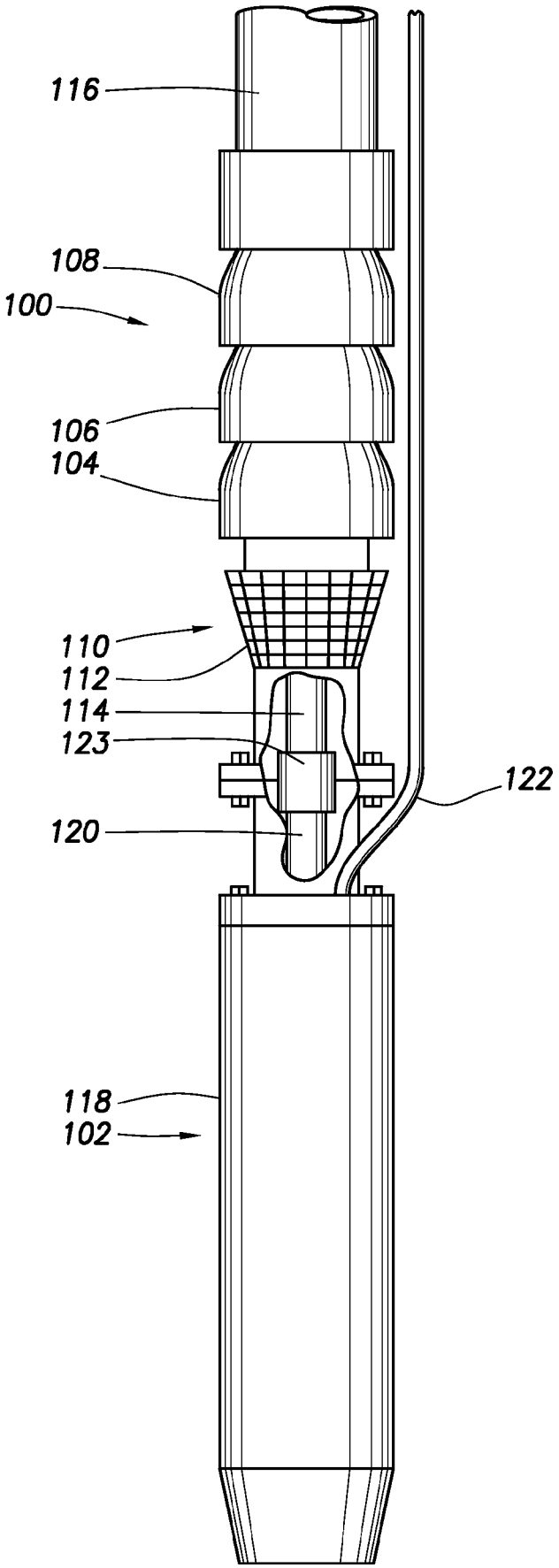
FIG. 1 shows a side elevation, partial cut-away, view of a submersible pump and submersible electric motor.

FIG. 1 shows a submersible pump and electric motor combination to orient the reader to the particular field of technology and various terms. In particular, FIG. 1 shows a side elevation, partial cut-away, view of a submersible pump 100 coupled to a submersible electric motor 102. The pump 102 in some embodiments is a submersible centrifugal pump, sometimes referred to as a "turbine pump". As illustrated, the pump 100 has three illustrative stages 104, 106, and 108, sometimes referred to as "bowls" because of their shape. In many cases, stages are individual assemblies that can be added or removed to achieve a particular design. The pump also has an inlet portion 110, illustratively covered by a screen 112 to reduce damage to the internal components of the pump caused by debris such as rocks. The exterior portion of the stages 104-106 visible in FIG. 1 are stationary components, and thus may be referred to as a stationary pump housing.

The pump 100 further comprises a rotatable pump shaft 114. The pump shaft 114 is the mechanism by which mechanical energy is supplied to the pump 100, and the pump 100 thus uses the mechanical energy to pump water through the pump 100 and out the discharge piping 116. Turbine pumps are available from many sources, such as Gicon Pumps & Equipment, LTD of Lubbock, Tex.

Still referring to FIG. 1, the pump system illustrated in FIG. 1 further comprises a submersible electric motor 102 coupled to the pump 100. The electric motor 102 comprises a stator or stationary motor housing 118, within which the stator windings are housed. The electric motor 102 further comprises a rotatable motor shaft 120, which rotatable motor shaft is rotated by the motor upon application of electrical energy to the electric motor, for example, by way of electrical cable 122. In some embodiments, the electric motor 102 is a sealed unit that does not allow water to contact the internal electrical components. In other cases, the water is allowed to flow into the electric motor 102 (e.g., applications where the water is relatively clean and/or pure). In any event, the electric motor 102 generates heat during operation, and the water in and/or around the electric motor 102 helps dissipate the heat. For this reason, submersible electric motors cannot be operated non-submerged, or cannot be operated non-submerged for extended periods of time. Electric motors for submersible applications may operate on single phase alternating current (AC) electrical energy, multiphase AC electrical energy, direct current (DC) electrical energy, and may operate on a wide variety of voltages (e.g., 120 Volt AC, 240 Volt AC, 4160 Volt AC). Submersible electrical motors suitable for submerged operation are available from a variety of sources, such as Gicon Pump & Equipment, LTD.

The rotatable motor shaft 120 of the electric motor 102 couples to the rotatable pump shaft 114 of the pump 100 by way of a coupling 123. Thus, rotational energy and torque created by the electric motor 102 is provided to the pump 100, and the pump 100 in turn uses the mechanical energy to pump water by drawing the water in through the inlet portion 110, and discharging the water through the discharge piping 116 at increased pressure.

The illustrative pump 100 and electric motor 102 of FIG. 1 are designed and constructed for operation with the rotatable shafts in a vertical orientation, as shown in FIG. 1. While it may be possible to operate a turbine pump and/or the electric motor with the rotatable shafts in a horizontal configuration, in many cases horizontal operation of a pump and/or electric motor designed for operation in a vertical orientation may cause less than optimal performance, and further may cause damage to the internal components. Moreover, dry or only partially wetted operation of an electric motor designed for submersible operation may cause damage by improper heat transfer from the windings.

Because of the limitations associated with pumps and/or electric motors designed for submersible, vertical orientation operation, simultaneous measurement of pump and electric motor performance in design configuration has not been possible. That is, horizontal shaft pumps and horizontal shaft electric motors (i.e., non-submersible devices) may be simultaneously tested by installing a torque meter between the electric motor and the pump, along with other measurement devices (e.g., flow meters, pressure transmitters, electrical current measurement devices). The horizontal shaft devices are then operated, and the performance measured, including the torque and RPM produced by the electric motor. However, for submersible application such as shown in FIG. 1, installing a torque meter between the pump and electric motor in submerged operation has not been possible, as the torque meter devices are electronic devices not suitable for submerged operation. There have been attempts to simultaneously test submersible pumps and submersible electric motors in a non-submersed environment, but such attempts appear to have involved only partially wetting the submersible pump and operating the devices in a horizontal configuration.

In order to at least partially address shortcomings in performance testing of submersible pumps and submersible electric motors, this specification discloses a system and method to test submersible pumps and submersible electric motors in a submersed environment. In particular, the specification discloses a vessel within which a torque meter may be disposed that enables performance testing in a submersed environment.

Figure 2:
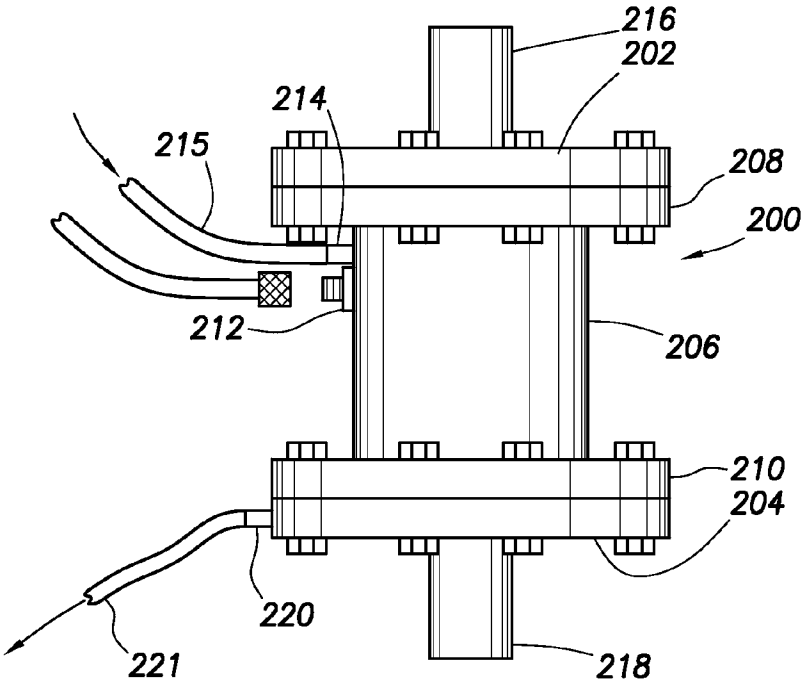
FIG. 2 shows a side elevation view of a vessel comprising a torque meter in accordance with at least some embodiments.

FIG. 2 shows a front elevation view of a vessel 200 in accordance with at least some embodiments. In particular, the vessel 200 comprises a top portion 202, a bottom portion 204, and a side wall 206 coupled between the top portion and the bottom portion. In at least some embodiments, the top portion 202 and bottom portion 204 are metallic flanges, and as discussed more below the top portion 202 and bottom portion 204 have apertures through which rotatable shaft portions extend. In some cases, the side wall 206 is a metallic pipe that has a circular cross section, but other cross-sectional shapes may be equivalently used. In the illustrative embodiments of FIG. 2, the side wall 206 couples to the top portion 202 and bottom portion 204 by way of flanges 208 and 210, respectively. In the various embodiments, the seal between the top portion 202 and the flange 208 is water tight, or substantially water tight. Moreover, the seal between the bottom portion 204 and the flange 210 is also water tight, or substantially water tight.

In accordance with the various embodiments, a torque meter is disposed within an interior volume of the vessel 200. Torque meters are electronic devices, and thus to supply power to the torque meter, as well as to send the torque readings to a computer system that collects performance data, in some embodiments an electrical connector 212 is disposed in the sidewall in such a way that the electrical conductors protrude through an aperture (not visible in FIG. 2) in the side wall 206. Inasmuch as the vessel 200 is intended to be submerged during periods of time when the torque meter is in operation, the electrical connector comprises a watertight connector, such as a cannon plug available from Newark of Chicago, Ill. In other cases, the electrical connector 212, and related aperture through the vessel 200, may be disposed through the top portion 202 or the bottom portion 204.

Still referring to FIG. 2, in accordance with at least some embodiments, the interior volume of the vessel 200 is held at an elevated pressure, and thus the vessel 200 further comprises a connector 214, and corresponding aperture, through which a pressurizing fluid, different than the water in which the vessel is submerged, flows into the interior volume of the vessel 200. For example, during periods of time when the vessel 200 is submerged, the pressurizing fluid may be provided to the interior volume by way of a tube 215 coupled to the connector 214, and the pressurizing fluid causing the interior volume of the vessel to be at a pressure the same or higher than the water pressure just outside the vessel 200. For example, if the vessel 200 is submerged in water to a depth of thirty two feet, then the absolute pressure within the interior volume of the vessel 200 may be 29.4 pounds per square inch absolute (PSIA) or more. In this way, to the extent any connection between components has a small leak, or the seals (discussed more below) that seal against the rotatable shaft of the torque meter leak, the pressure of the interior volume will tend to force its way out, thus reducing the likelihood that water will enter the interior volume. The pressurizing fluid may take any suitable form such as air, nitrogen, argon, carbon dioxide, or non-conductive oil.

In accordance with a particular embodiment, in addition to pressurizing the interior volume, a monitoring system can be implemented to detect water penetration into the interior volume. In such embodiments, the vessel 200 further comprises drain aperture (not visible in FIG. 2) fluidly coupled to the interior volume, and where the drain aperture resides at the bottom of the vessel. The drain aperture couples to a drain connector 220, which may couple to a tube 221 that extends to the surface. During periods of time when the vessel 200 is well sealed, only the pressurizing fluid should flow through connector 220 and tube 221. However, if water finds its way to the interior volume, gravity will tend to force the water to collect near the bottom of the interior volume or the non-conductive oil will float on the top of the water and the water will collect near the bottom of the interior volume. As will be discussed more below, the drain aperture is situated near the bottom such that any water that enters the vessel 200 will eventually be forced out the drain aperture, through the connector 220 and tube 221, and thus be detectable at the surface.

Still referring to FIG. 2, in accordance with a particular embodiment, in addition to pressurizing the interior volume, the pressurizing fluid is pumped out of the vessel to a fluid storage container (not shown in FIG. 2) located above the surface of the water. In such embodiments, the pressurizing fluid flows out of the vessel by way of tube 221. Tube 221 may be operationally connected to a pump (not shown in FIG. 2) which pumps the pressurizing fluid from the vessel to the fluid storage container.

Figure 3:
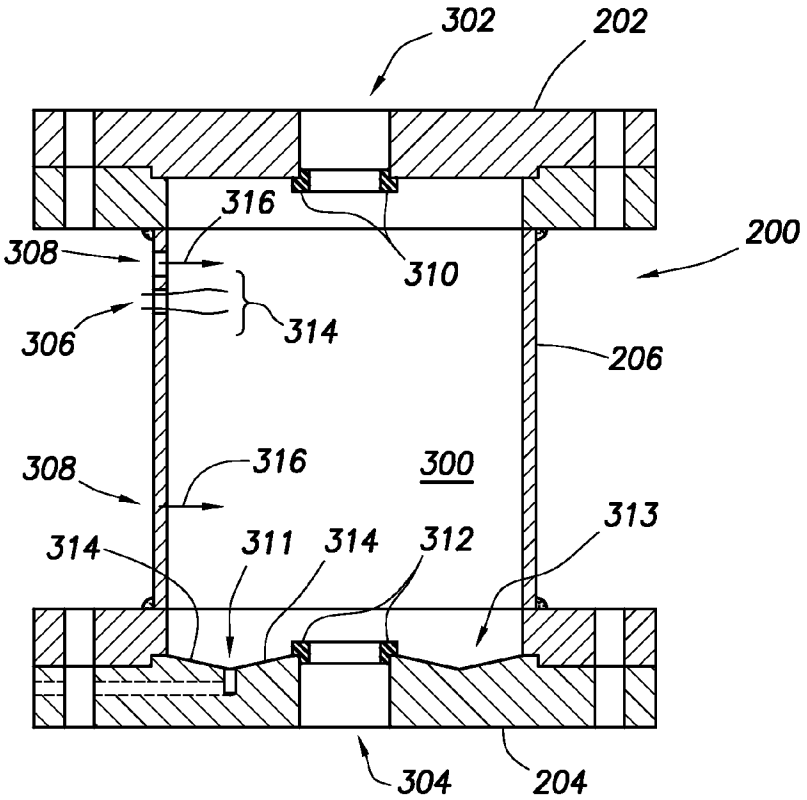
FIG. 3 shows a cross-sectional elevation view of a vessel in accordance with at least some embodiments.

FIG. 3 shows a cross-sectional view of the vessel 200 with the torque meter removed. In particular, FIG. 3 illustrates the top portion 202, bottom portion 204, and side wall 206 as shown in FIG. 2. Also visible in the cross-sectional view is the interior volume 300, along with the top aperture 302, bottom aperture 304, connector aperture 306, pressuring fluid aperture 308, and drain aperture 311. Each will be discussed in turn, starting with the top and bottom apertures 302 and 304.

As discussed above, a torque meter is disposed within the interior volume 300. The torque meter defines a rotatable shaft such that the torque meter can measure torque applied to the rotatable shaft and the RPM of the rotatable shaft. The rotatable shaft of the torque meter extends through the top portion 202 and bottom portion 204 through the top aperture 302 and bottom aperture 304, respectively. In some cases a seal is disposed between the rotatable shaft of the torque meter and the stationary vessel, as illustrated by seal 310 associated with the top aperture 302, and seal 312 associated with the bottom aperture 304. The seals 310 and 312 may take any suitable form. For torque meters with smaller diameter rotatable shafts (and correspondingly smaller apertures 302 and 304), o-ring seals may sufficient. For larger diameter rotatable shafts, more complex seal systems may be used, such as the ISOMAG MAGNUM-S cartridge magnetic bearing seal available from John Crane Inc. of Morton Grove, Ill. Other seals, and other seal systems, may be equivalently used.

Connector aperture 306 is shown with the electrical connector removed for clarity. However, FIG. 3 does show a plurality of conductors 314 protruding through the aperture 306. Again, while FIG. 2 shows a cannon plug-style electrical connector, any suitable connector may be equivalently used. FIG. 3 likewise shows pressurizing fluid aperture 308 through which pressurizing fluid may flow to hold the interior volume 300 at or above the pressure of the water just outside the vessel 200, the pressurizing fluid flow illustrated by arrow 316.

Still referring to FIG. 3, some embodiments the vessel comprises drain aperture 311. Only a portion of the drain aperture 311 is visible in the cross-sectional view of FIG. 3, but the path of the drain aperture to the connector 220 (FIG. 2) is shown in dashed lines. As illustrated, the drain aperture is disposed at or near the bottom of the vessel such that any water that enters the vessel will find its way to the drain aperture 311. FIG. 3 illustrates yet still further embodiments where drainage of water to the drain aperture 311 is aided by a trough 313 in the bottom portion 204, where the trough circumscribes the bottom aperture 304. In particular, the trough 313 defines sloped walls 314 which force water to lowest point of the trough. Though not visible in the cross-section of the FIG. 3, the lowest point of the trough 313 may itself slope toward the drain aperture 311, again to aid the flow of water toward the drain aperture 311. In cases that use the flow of pressurizing fluid into the interior volume 300, a corresponding flow of pressurizing fluid is induced in the drain aperture 311, corresponding connector 220 (FIG. 2), and tube 221. In accordance with at least some embodiments, the fluid flow through the drain aperture 311 is monitored either at the surface or in the fluid storage container. If water is found, or if the rate of water accumulation measured is over a predetermined threshold, such is indicative of a leak, and thus the vessel 200 should be removed and repaired before the water damage to the torque meter occurs.

Figure 4:
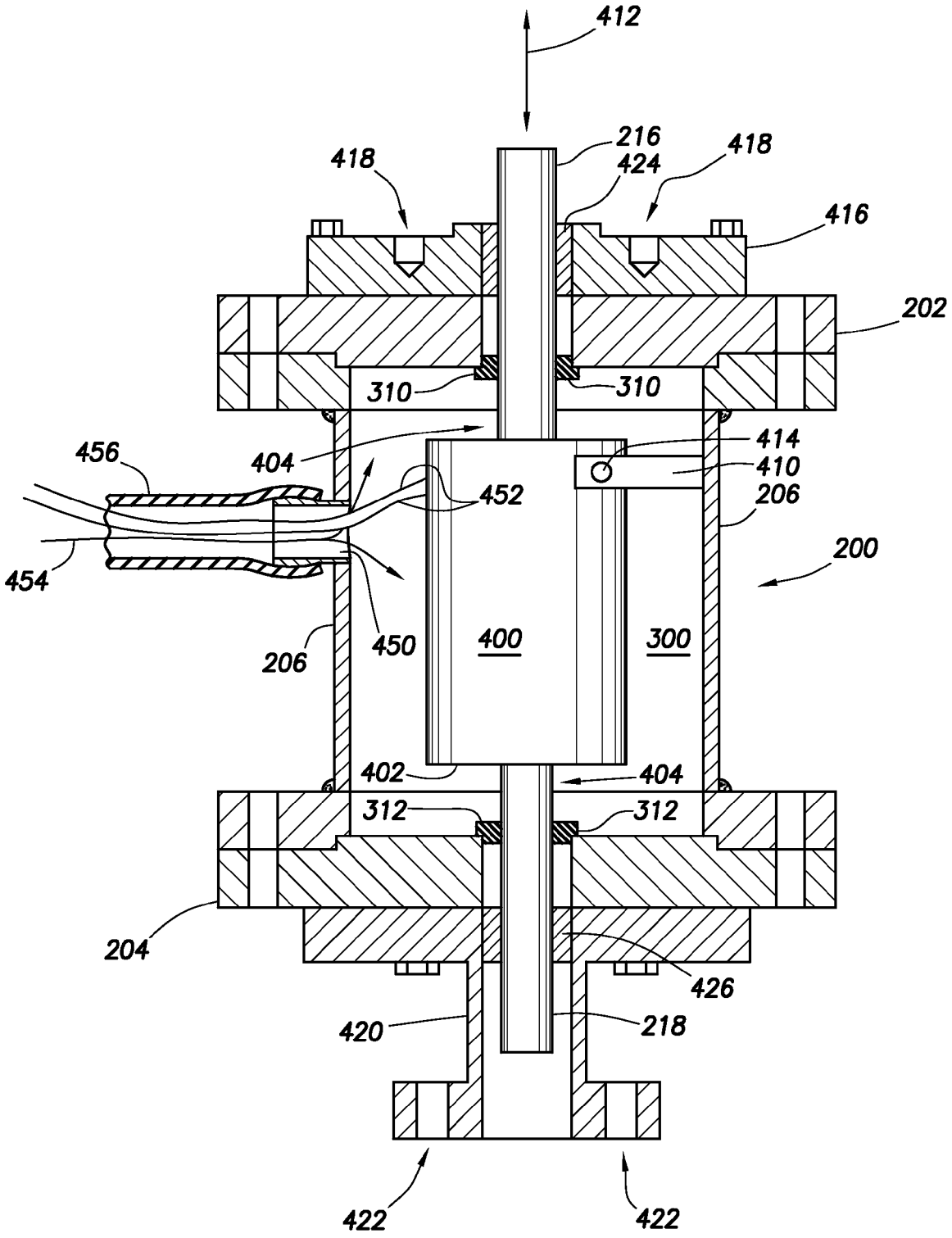
FIG. 4 shows a cross-section elevation view of a vessel, along with an elevation view of a torque meter, in accordance with at least some embodiments.

FIG. 4 shows a cross-sectional elevation view of the vessel 200 showing a torque meter installed therein, and also showing adapters to enable coupling to a pump and an electric motor. In particular, the vessel 200 has a torque meter 400 disposed within the interior volume 300. The torque meter defines a meter housing 402, as well as a rotatable shaft 404 that comprises a first end 216 that protrudes through the top aperture, and a second end 218 that protrudes through the bottom aperture. Torque provided to the second end 218 of the rotatable shaft 404 (e.g., from a submersible electric motor) is transferred to the first end 216 of the rotatable shaft 404 and on to other devices (e.g., a submersible pump). In the process, the torque meter 400 measures the torque transferred, and also measures the RPM of the rotatable shaft. One such torque meter that may be used is the MCRT® 79700V non-contact dual-range digital torque meter available from S. Himmelstien and Company, of Hoffman Estates, Ill. Other brands of a torque meters may be equivalently used.

In order for the torque meter 400 to measure torque and RPM, the meter housing 402 should remain rotationally stationary relative to the rotatable shaft 404. In accordance with at least some embodiments, the system comprises a stabilizing member 410 coupled between the vessel 200 (in the illustrative case of FIG. 4, the side wall 206) and the meter housing 402. In some embodiments, axial movement of the torque meter is contemplated (the axial movement illustrated by double-headed arrow 412, and thus the stabilizing member 410 may hold the meter housing 402 rotationally stationary, but enable axial movement. As illustrated, the stabilizing member 410 is a strap (e.g., metallic, fabric, plastic) coupled by way of a fastener 414.

Still referring to FIG. 4, the vessel 200 with the torque meter 400 disposed at least partially therein is coupled between a submersible electric motor and a submersible pump. FIG. 4 illustrates a pump coupler 416 coupled to the top portion 202. The pump coupler 416 enables the pump to bolt to the vessel 200, and further enables the rotatable shaft of the pump (not shown in FIG. 4) to align with and couple to the first end 216 of the rotatable shaft 404. For example, an extension portion of the pump may bolt to the illustrative internally threaded bolt apertures 418.

Likewise, the vessel 200 with the torque meter 400 disposed therein couples to a submersible electric motor. FIG. 4 illustrates a motor coupler 420 coupled to the bottom portion 204. The motor coupler 420 enables the electric motor to bolt to the vessel 200, and further enables the rotatable shaft of the electric motor (not shown in FIG. 4) to align with and couple to the second end 218 of the rotatable shaft 404. For example, the motor coupler 420 may bolt to the illustrative electric motor by way of apertures 422. Before proceeding, it is noted that the pump coupler 416 and motor coupler 420 are merely illustrative, and may equivalently take any suitable form to match coupling mechanisms of the pump and electric motor respectively.

Still referring to FIG. 4, in a particular embodiment the system further comprises an upper bearing 424 and a lower bearing 426. As illustrated, the upper bearing 424 is disposed between the pump coupler 416 and the rotatable shaft 404, and the lower bearing 426 is disposed between the motor coupler 420 and the rotatable shaft. In embodiments where bearings 424 and 426 are used, the bearings may be of any suitable type, such as bronze bearings. It is noted that bearings 424 and 426 may be omitted, particularly for smaller rotatable shaft 404 diameters and/or lower torque systems. Moreover, in some cases the seals 310 and 312 may also serve as bearings.

FIG. 4 also illustrates alternative embodiments where the pressurizing fluid for the interior volume 300 and the electrical conductors that couple to the torque meter 400 are provided through the same aperture. In particular, FIG. 4 illustrates aperture 450 through the side wall 206. Aperture 450 is sized such that not only can electrical conductors 452 protrude through the aperture 450, but also the pressurizing fluid flow (illustrated by arrows 454) also flows through the aperture. In such embodiments, the electrical conductors from the surface extend through the tube 456, and are thus are kept in a dry environment, not exposed to the water surrounding the vessel 200.

Figure 5:
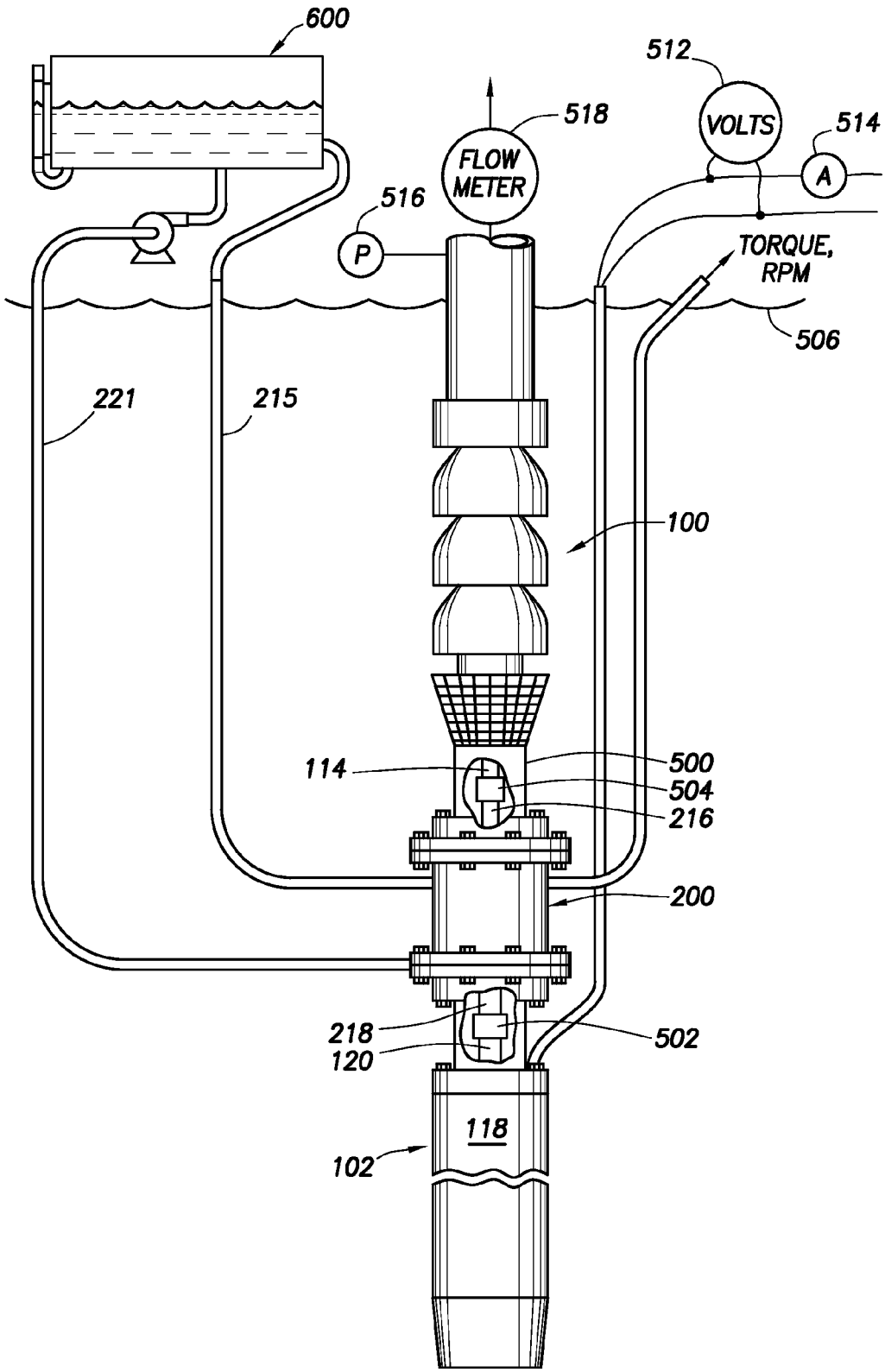
FIG. 5 shows a side elevation, partial cut-away, view of a submersible pump and submersible electric motor coupled by way of a vessel in accordance with at least some embodiments.

FIG. 5 shows a system in accordance with at least some embodiments. In particular, FIG. 5 shows an electric motor 102 coupled to water pump 100 by way of vessel 200. More particularly still, the stationary motor housing 118 couples to the vessel 200, and the vessel 200 couples to the stationary pump housing 500, and as illustrated the water pump 100, vessel 200 and electric motor 102 are suspended by the outlet pipe. Moreover, the rotatable shaft 120 of the electric motor 102 couples to the second end 218 of the rotatable shaft 404 of the torque meter by way of a coupling 502, and the rotatable shaft 114 of the water pump 100 couples to the first end 216 of the rotatable shaft 404 of the torque meter by way of a coupling 504. Thus, the stationary components are coupled together, and the rotatable shafts are coupled together, and the entire assembly is submerged below the surface 506 of the water.

In operation, the pressurizing fluid may be provided to the vessel by way of tube 215 and return by way of tube 221. The pressurizing fluid that returns may be checked for water entrainment. Water entrainment may be indicative of a water leak into the interior volume of the vessel 200, and thus may dictate removal of the assembly from the submersed orientation to ensure the torque meter is not damaged.

While the electric motor 102 is operating, the voltage supplied to the electric motor 102 may be measured (such as by voltage meter 512), and simultaneously the amperage drawn may be measured (such as by amp meter 514). From voltage and amperage, the electrical power provided to the electric motor may be determined. Moreover, while the electric motor is operating the head pressure developed by the pump 100 may be measured (such as by pressure gauge 516), and the flow of water may be measured (such as by flow meter 518). Further, while the electric motor 102 is operating and the pump 100 is producing pressure and flow, the torque provided by the electric motor 102 may be measured by way of the torque meter in the vessel 200. Likewise, the RPM of the electric motor (and thus the pump) may also be measured by the torque meter. Using such information, and possibly by restricting the flow of water from the pump (such as by a surface valve), the performance of the both the pump and motor may be simultaneously measured over a range of pump flow rates.

The various embodiments have presented the vessel 200 and internal torque meter as a short term test mechanism for performance testing; however, in other embodiments the vessel 200 and internal torque meter may be a permanent or semi-permanent installation that enables measuring performance of the pump and electric motor over time, for example, to gauge or rate performance degradation.

Figure 6:
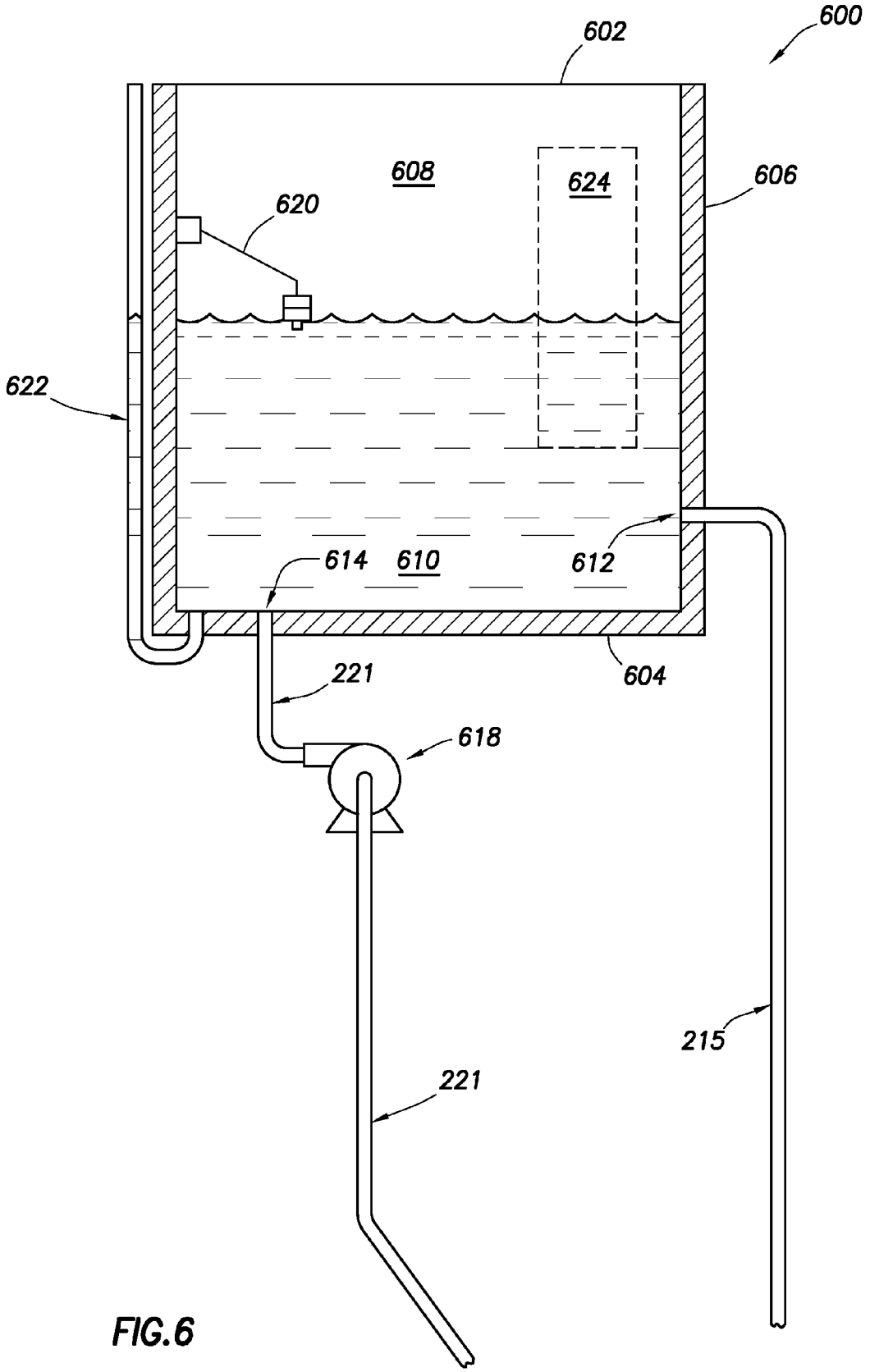
FIG. 6 shows a side elevation, partial cut-away, view of a fluid storage container, in accordance with at least some embodiments.

FIG. 6 shows a cross-sectional view of a fluid storage container in accordance with at least some embodiments. The fluid storage container 600 is a container that stores and contains the fluid used to pressurize the vessel. The fluid storage container can be made of any suitable material, such as metal or plastic, and one such fluid storage container is a 55 gallon drum available from W.W. Grainger, Inc.

In particular, FIG. 6 shows a fluid storage container 600 that comprises a top portion 602, a bottom portion 604, and a side wall 606 coupled between the top portion and the bottom portion. Also visible in the cross-sectional view is the interior volume 608 and pressurizing fluid 610. In one example system, pressurizing fluid 610 flows by force of gravity through aperture 612 and tube 215 to the vessel. The pressurizing fluid returns to the fluid storage container by way of tube 221 and through aperture 614. In some embodiments the pressurizing fluid may be returned to the fluid storage container by using pump 618 to pump the pressurizing fluid from the vessel to the fluid storage container by way of tube 221.

Still referring to FIG. 6, in some embodiments it may be desirable to determine if a leak exists such that pressurizing fluid is being lost. By measuring the fluid level, one can determine whether pressurizing fluid may be leaking from the vessel 200; from the fluid storage container 600; from tube 221; from tube 215, or from any other component. Therefore, in such embodiments, a fluid level indicator may be present, such as a floating fluid level sensor 620 or a sight glass fluid level monitor 622. One such floating fluid level sensor 620 that may be used is a single point float switch available from Gems™ Sensors & Controls, of Plainville, Conn. Other suitable fluid level indicators 624 may also be used, including: demarcations of level on the wall of the fluid storage container, a hydrostatic fluid level measurement device, a load cell, a strain gauge device, a magnetic level gauge, a capacitance transmitter, a magnetostrictive level transmitter, or an ultrasonic, laser, or radar level transmitter.

Further, still referring to FIG. 6, in accordance with some embodiments, it may be desirable to determine whether water is entering the fluid storage container 600 or the vessel 200 and contaminating the pressurizing fluid 610. FIG. 6 shows a sight glass 622 which may operate to detect water contamination. Further, water contamination may also be indicative of a leak into the interior volume of the vessel 200. In certain embodiments where the pressurizing fluid 610 is non-conductive oil, one may measure contamination of the pressurizing fluid by visually inspecting the pressurizing fluid 610 for the presence of water on bottom portion 604 of the fluid storage container 600 using sight glass 622. Contamination of the pressurizing fluid 610, by not only water but by any substance other than the pressurizing fluid 610, may be measured using any of the fluid level indicators previously identified.

Figure 7:
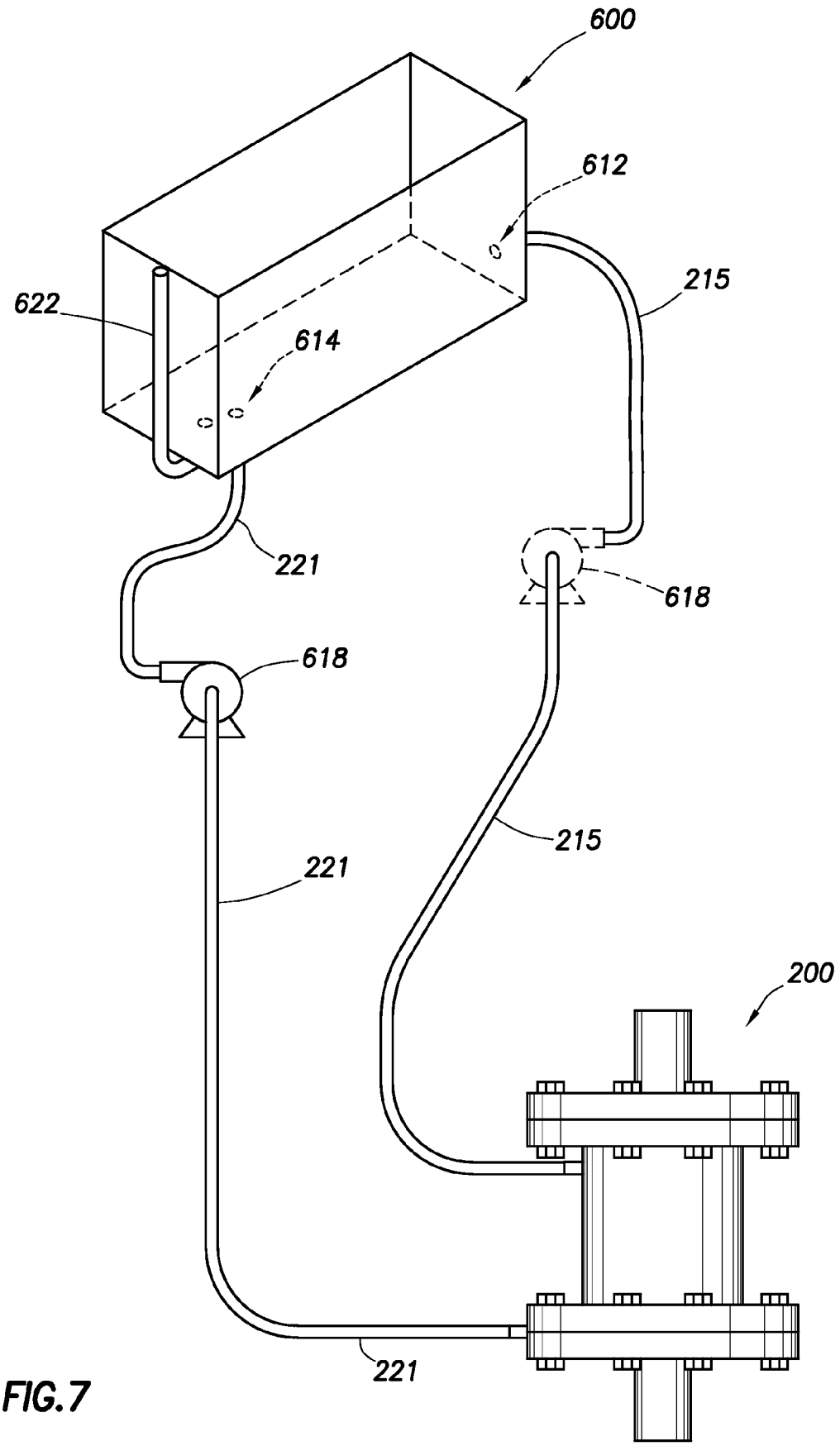
FIG. 7 shows a perspective view of a fluid storage container, in accordance with at least some embodiments.

FIG. 7 shows a perspective view of a fluid storage container 600 in accordance with at least some embodiments. FIG. 7 shows a fluid storage container 600 with sight glass 622. FIG. 7 demonstrates that, in accordance with some embodiments, the pressurizing fluid 610 can be pumped by pump 618 out of the fluid storage container 600 by way of aperture 612 and through tube 215 to vessel 200. FIG. 7 also shows that the pressurizing fluid 610 may also be pumped from the vessel 200 to the fluid storage container 600 by pump 618 though tube 221, and enter the fluid storage container 600 by way of aperture 614.

Figure 8:
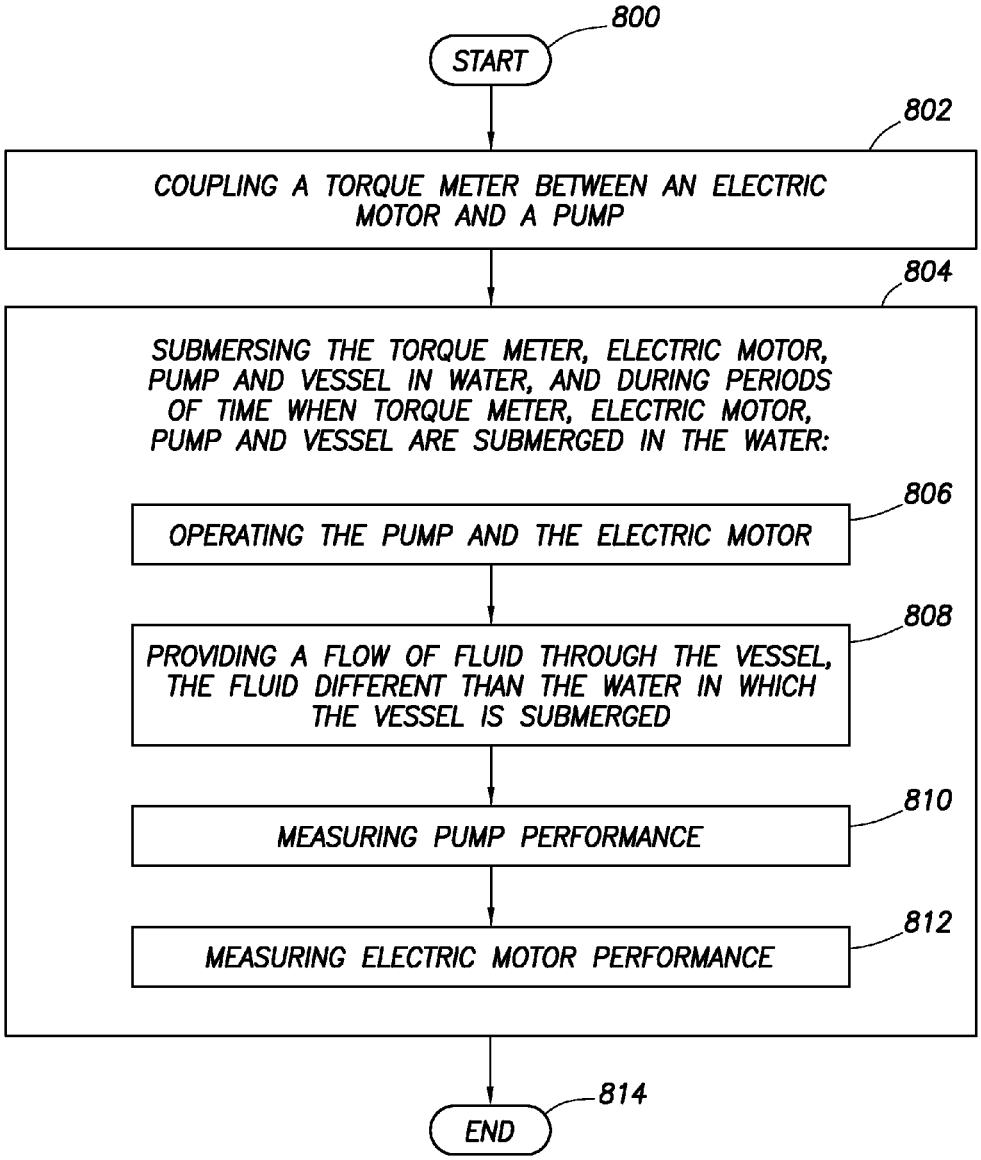
FIG. 8 shows a method in accordance with at least some embodiments.

FIG. 8 shows a method in accordance with at least some embodiments. In particular, the method starts (block 800) and comprises: coupling a torque meter between an electric motor and a pump (block 802); submersing the torque meter, electric motor, pump and vessel in water (block 804). During periods of time when the torque meter, electric motor, pump and vessel are submerged in the water: operating the pump and the electric motor (block 806); providing a flow of fluid through the vessel, the fluid is different than the water in which the vessel is submerged (block 808); measuring pump performance (block 810); and simultaneously measuring electric motor performance (block 812). Thereafter, the method ends (block 814).

The above discussion is meant to be illustrative of the principles and various embodiments of the present invention. Numerous variations and modifications will become apparent to those skilled in the art once the above disclosure is fully appreciated. For example, the rotatable shaft of the torque meter is shown to have the same length extending from each side of the housing; however, the rotatable shaft need not be of equal length on each side. Moreover, the vessel is presented as metallic to enable the system to be used in high torque situations; however, in lower torque cases, the vessel may be constructed of other materials, such as plastics. In cases where the manufacturer of the vessel within which the torque meter is installed is confident the seals will not leak, the use of pressurizing fluid may be equivalently omitted. It is intended that the following claims be interpreted to embrace all such variations and modifications.

What is claimed is:

1. A method comprising:

coupling a torque meter between an electric motor and a pump;

submersing the torque meter, electric motor, and pump in water, and during periods of time when the torque meter, electric motor and pump are submerged in the water:

operating the pump and the electric motor;

providing a flow of fluid through the vessel, the fluid different than the water in which the vessel is submerged;

measuring pump performance; and simultaneously measuring electric motor performance.

2. The method of claim 1 wherein providing the flow of fluid further comprises feeding the fluid under force of gravity to the vessel from a fluid storage container residing above a surface of the water.

3. The method of claim 2 wherein providing further comprises pumping the fluid from the vessel back to the fluid storage container.

4. The method of claim 1 further comprising detecting loss of the fluid from the vessel into the water.

5. The method of claim 4 wherein detecting loss of the fluid further comprises measuring level of the fluid in a fluid storage container fluidly coupled to the vessel.

6. The method of claim 1 further comprising detecting invasion of water into the vessel.

7. The method of claim 6 wherein detecting invasion of water further comprises:

recirculating the fluid from the vessel to a fluid storage container disposed above a surface of the water; and then detecting water in the fluid storage container.

8. The method of claim 1 wherein providing the flow of fluid further comprises providing the flow of fluid being a non-conductive oil.

9. The method of claim 1 wherein measuring pump performance further comprises, simultaneously:

measuring torque provided to the pump by the electric motor;

measuring rotational rate at input shaft of the pump;

measuring water pressure produced by the pump;

measuring water flow produced by the pump.

10. The method of claim 1 wherein measuring motor performance further comprises, simultaneously:

measuring rotational rate of an output shaft of the electric motor;

measuring torque provided by the electric motor; and measuring electrical power provided to the electric motor.

11. The method of claim 1 further comprising monitoring fluid flow carried within a tube fluidly coupled to the interior volume of the vessel, the tube distinct from the tube that provides fluid to the vessel, and the monitoring during periods of time when the torque meter is submersed in the water.

12. The method of claim 1 wherein the pump defines a rotatable shaft, the torque meter defines a rotatable shaft, and the electric motor defines a rotatable shaft, and wherein operating the pump and the electric motor further comprises operating with the shafts in a substantially vertical orientation.

13. The method of claim 1 wherein submersing further comprises suspending the pump, torque meter, and electric motor in the water.

14. The method of claim 1 wherein measuring pump performance further comprises measuring at least one selected from the group consisting of: head; fluid flow; and power provided to the pump.

15. The method of claim 1 wherein measuring electric motor performance further comprises measuring at least one selected from the group consisting of: voltage provided to the electric motor; current drawn by the electric motor; revolutions per unit time of a rotor of the electric motor; torque provided by the rotor of the electric motor.

16. A system comprising:

a water pump that defines a rotatable pump shaft and a stationary pump housing, the water pump submersed in water, and the pump shaft in a substantially vertical orientation;

an electric motor that defines a rotatable motor shaft and a stationary motor housing, the rotatable motor shaft coupled to the rotatable pump shaft, the electric motor submerged in the water below the water pump, and the rotatable motor shaft in a substantially vertical orientation;

a torque meter at least partially disposed within a sealed vessel, the vessel submersed in the water, and the torque meter comprising:

a rotatable torque meter shaft;

a first end of the torque meter shaft protrudes from the vessel and is coupled to the pump shaft; and a second end of the torque meter shaft protrudes from the vessel and is coupled to the motor shaft such that torque provided by the electric motor is coupled to the pump shaft through the torque meter;

wherein the vessel is coupled between the stationary pump housing and the stationary motor housing;

a fluid storage container disposed above a surface of the water, the fluid storage container defines an interior volume containing a fluid, and the interior volume fluidly coupled to an interior volume of the sealed vessel;

a fluid level indicator in operational relationship to the fluid storage container, the fluid level indicator configured to indicate level of the fluid within the interior volume of the fluid storage container; and a fluid contamination indicator in operational relationship to the fluid storage container, the fluid contamination indicator configured to indicate invasion of water into the sealed vessel.

17. The system of claim 16 a fluid pump fluidly coupled between the fluid storage container and the interior volume of the sealed vessel, wherein the pump is configured to pump fluid from the interior volume of the sealed vessel to the fluid storage container.

18. The system of claim 16 further comprising a pump fluidly coupled between the fluid storage container and the interior volume of the sealed vessel, wherein the pump is configured to pump fluid from the fluid storage container to the sealed vessel.

19. The system of claim 16 wherein the fluid level indicator is at least one selected from the group consisting of: a sight glass in operational relationship with the interior volume of the fluid storage container; demarcations of level associated with walls of the fluid storage container; an electronic level indicator in operational relationship to the fluid; a float assembly floating at a surface of the fluid; a hydrostatic fluid level measurement device, a load cell, a strain gauge device, a magnetic level gauge, a capacitance transmitter, a magnetostrictive level transmitter, and an ultrasonic, laser, or radar level transmitter.

20. The system of claim 16 wherein the fluid contamination indicator is at least one selected from the group consisting of: a sight glass in operational relationship with the interior volume of the fluid storage container; demarcations of level associated with walls of the fluid storage container; an electronic level indicator in operational relationship to the fluid; a float assembly floating at a surface of the fluid;

a hydrostatic fluid level measurement device, a load cell, a strain gauge device, a magnetic level gauge, a capacitance transmitter, a magnetostrictive level transmitter, and an ultrasonic, laser, or radar level transmitter.

21. The system of claim 16 wherein the fluid is non-conductive oil.

22. The system of claim 16 wherein the fluid level indicator and the fluid contamination indicator are a single sight glass.

23. The system of claim 16 further comprising a pressurizing fluid that flows from the fluid storage container through a first aperture into the interior volume, wherein the pressurizing fluid causes the pressure within the interior volume to be greater than pressure of the water outside the vessel.

24. The system of claim 16 further comprising a second aperture through the vessel through which a pressurizing fluid flows from a fluid storage container into the interior volume, wherein the pressurizing fluid causes the pressure within the interior volume to be greater than pressure of the water outside the vessel.

* * * * *